United States Patent [19]

Bertovich

[11] 4,064,986

[45] Dec. 27, 1977

[54] ESCALATOR HAVING GUIDE WHEELS AND GUIDE TRACK WITH COOPERATIVE NON-FLAT SURFACES

[75] Inventor: Matthew G. Bertovich, Monroeville Borough, Pa.

[73] Assignee: Westinghouse Electric Corporation, Pittsburgh, Pa.

[21] Appl. No.: 681,963

[22] Filed: Apr. 30, 1976

[51] Int. Cl.[2] ..... B66B 9/12

[52] U.S. Cl. ..... 198/326; 198/838; 198/845

[58] Field of Search ..... 198/326, 332, 333, 838, 198/845

[56] References Cited

U.S. PATENT DOCUMENTS

| | | | |
|---|---|---|---|
| 1,956,153 | 4/1934 | Lindquist et al. | 198/326 |
| 2,905,308 | 9/1959 | Hansen | 198/332 |
| 3,082,861 | 3/1963 | Kornylak | 198/838 |
| 3,682,289 | 8/1972 | Kraft | 198/332 |

FOREIGN PATENT DOCUMENTS

| | | | |
|---|---|---|---|
| 818,161 | 8/1959 | United Kingdom | 198/332 |

*Primary Examiner*—Evon C. Blunk
*Assistant Examiner*—Jeffrey V. Nase
*Attorney, Agent, or Firm*—D. R. Lackey

[57] ABSTRACT

An escalator including an endless belt and a plurality of steps attached thereto. The endless belt and steps are guided about a loop which includes load bearing and return runs for the steps, by guide wheels rotatably mounted on a common side of the endless belt, and a guide track. The guide wheels and guide track have cooperative, non-flat surfaces which guide the endless belt and steps about the loop, as well as provide the required support for the associated side of the endless belt.

16 Claims, 6 Drawing Figures

ESCALATOR HAVING GUIDE WHEELS AND GUIDE TRACK WITH COOPERATIVE NON-FLAT SURFACES

BACKGROUND OF THE INVENTION

1. Field of the Invention

The invention relates in general to escalators or moving stairways, and more specifically to new and improved arrangements for guiding passenger conveyors of this type.

2. Description of the Prior Art

An escalator must be accurately guided laterally during its travel about the endless loop. The American National Safety code for escalators ANSI A17.1-1971 Rule 802.3C requires that "the clearance on either side of the steps between the step tread and the adjacent skirt panel shall not be more than three-eighths (⅜) inch." Also, the steps must be laterally guided into the combplates.

Escalators conventionally are laterally guided by upstanding guide portions disposed on the tracks which support the main step wheels or rollers. The sides of the step wheels contact the guide portions on the tracks when a dimensional lateral limit is reached, in either lateral direction. The scuffing action between the sides of the wheels and the guiding portions produces noise and wear, necessitating frequent lubrication in order to reduce the noise and wear to acceptable values.

U.S. Pat. No. 3,682,289, which is assigned to the same assignee as the present application, improved the lateral guiding of the steps by guiding from the back side of the skirts via a plurality of auxiliary wheels which bear against auxiliary guide angle members fastened to the skirts.

In both the conventional and improved lateral guiding arrangements mentioned above, the positions of both the left and righthand guides are critical, requiring jigs and fixtures for accurately positioning the guide angle members on both sides of the escalator during manufacture. Further, the field installation and alignment of both guides is critical.

U.S. Pat. No. 1,956,153 discloses grooving one of the main roller tracks to provide a guide member on each edge of one of the tracks, thus guiding from the inside and outside edges of the main rollers on one side of the escalator, and removing the criticality in the position of the track on the other side of the escalator. This arrangement, however, rapidly wears the inner and outer edges of the guided rollers, as all side thrust is taken by these edges.

In all of the above-mentioned guiding arrangements, upthrust of the endless belt to which the steps are attached is accommodated and limited to a predetermined dimension by upthrust tracks spaced above the main wheels or rollers. If a main wheel lifts off its support track, it is limited in its movement by the spacing between the wheel and the upthrust track. When the main wheel strikes the upthrust track, a force is produced on the wheel which attempts to rotate it in a circumferential direction opposite to its present direction, causing scraping and wear, as well as objectionable vibration and noise.

It would be desirable to provide a new and improved escalator having a lateral guiding arrangement which simplifies the manufacture of the escalator, without offsetting disadvantages, such as increased wear, noise and vibration. It would also be desirable to provide the upthrust limit function without the wear, noise and vibration associated with prior art arrangements.

SUMMARY OF THE INVENTION

Briefly, the present invention is a new and improved escalator, and improved lateral guiding means therefor, which simplifies the manufacture, installation and alignment of the main wheel track system, while providing lateral guidance of the steps through the entire track system and turn-arounds. Further, the improved guiding arrangement reduces wear, vibration and noise, and also improves the upthrust limit function.

More specifically, the guiding function is performed from one side of the escalator by guide wheels and a guide track which cooperatively guide the endless belt and steps without increased wear of the guide wheels. The contacting portions of the guide wheels and guide track are non-flat, having curved or contoured surfaces which cooperate to provide a nesting arrangement in which the guide wheels are centered on the guide track by self-centering forces created with minimal differential velocities which accelerate wear of the wheel. In the preferred embodiment, the cross-sectional configuration of the guide track defines a concave guiding surface, and the tread on the guide wheel is formed with a different curve which enables the wheel to enter the concave surface of the guide track without contacting the side walls of the guide. This arrangement creates substantially a line contact with the bottom portion of the concave guide surface of the guide track. Side thrusts are accommodated with minimal wear on the guide wheels as the curved side wall of the wheel which is forced into contact with the curved guide track by the lateral forces is moving at substantially the same velocity as the more central portions of the wheel, resulting in substantially no scuffing or scraping of the wheel on the guide track.

An improved upthrust limit function is provided by guard wheels mounted coaxially with the guide wheels on the same side of the endless belt, and a guard track disposed on the opposite side of the rotational axis of the guide and guard wheels as the guide track. In certain portions of the endless loop, the guard track is adjusted to contact the guard rollers to precisely position the endless belt and steps, such as during the turn-arounds, in the combplate areas, and in the area of the driving means. Further, the contoured guide rollers may be protected from damage in the short adjustable transition areas at each end of the escalator, by eliminating the guide track in the transition areas and providing a support track for the guard rollers. The guard wheels, in cooperation with the contoured guide wheels also function to limit lateral movement of the endless belt and connected steps. A guide wheel can only ride up a side of the guide track until the guard wheel contacts the guard track, thus preventing any further lateral movement.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
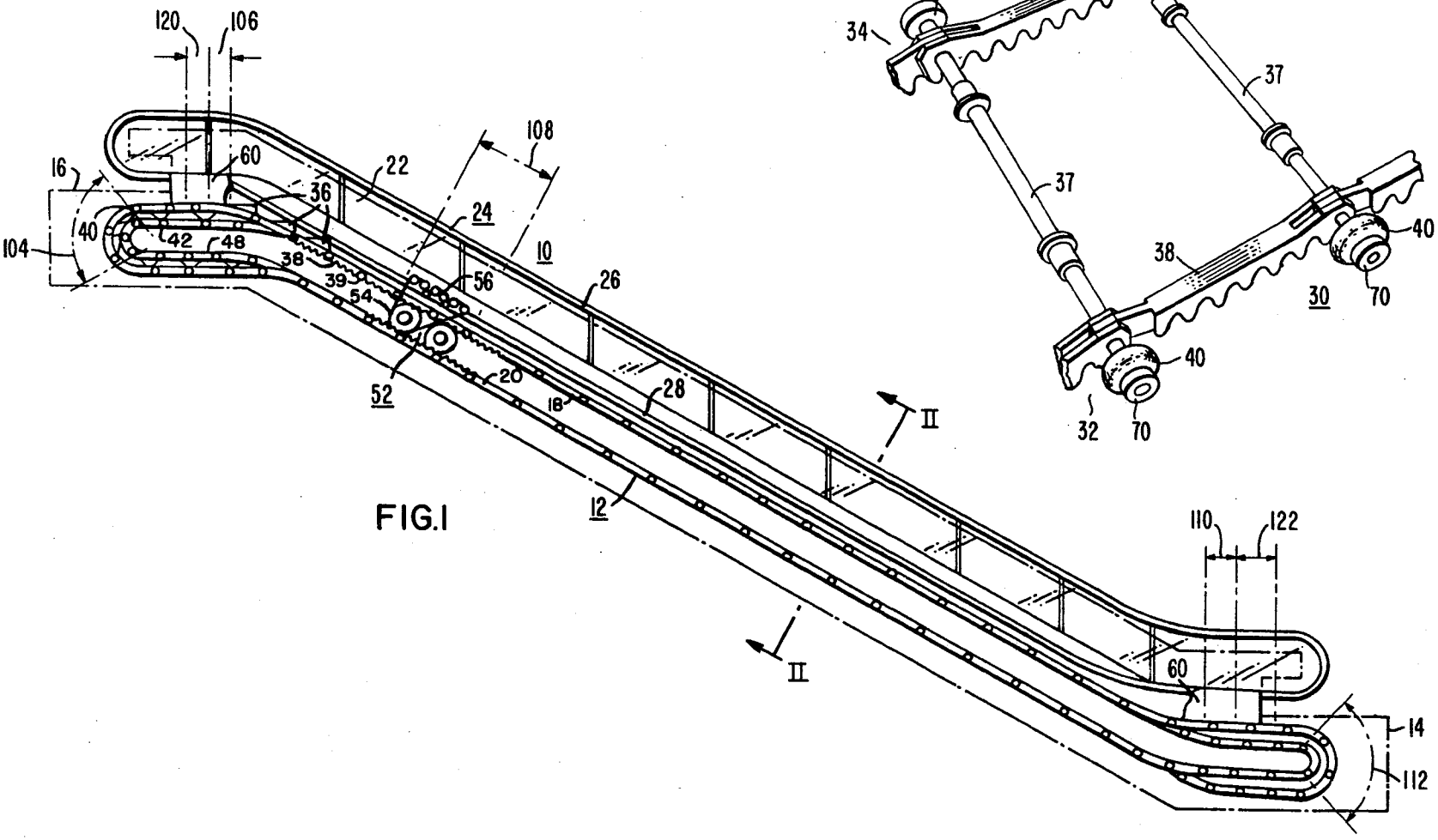
FIG. 1 is a schematic elevational view of an escalator which may be constructed according to the teachings of the invention.

Referring now to the drawings, and FIG. 1 in particular, there is shown an escalator 10 of the type which may utilize the teachings of the invention. Escalator 10 employs a conveyor 12 for transporting passengers between a first landing 14 and a second landing 16. The conveyor 12 is of the endless type, having an upper load run 18 on which passengers stand while being transported between the landings, and a lower return run 20.

A balustrade 22 is disposed above the conveyor 12 for guiding a continuous, flexible handrail 24. The balustrade guides the handrail 24 as it moves about a closed loop which includes an upper run 26 during which a surface of the handrail 24 may be grasped by passengers as they are transported along the conveyor 12, and a lower return run 28. The balustrade 22 may be transparent, as indicated, or opaque, as desired. The handrail 24 is guided around the balustrade by suitable guide means, such as a T-shaped guide member which is located within the C-shaped cross-section of the handrail 24.

Conveyor 12 includes a plurality of steps 36, only a few of which are shown in FIG. 1. The steps are each clamped to a step axle 37, shown in FIG. 2, and they move in a closed path, with the conveyor 12 being driven in a conventional manner, such as illustrated in U.S. Pat. No. 3,414,109, or the conveyor 12 may be driven by a modular drive arrangement as disclosed in U.S. Pat. No. 3,677,388, both of which are assigned to the same assignee as the present application. For purposes of example, the modular drive arrangement is shown in FIG. 1.

Figure 3:
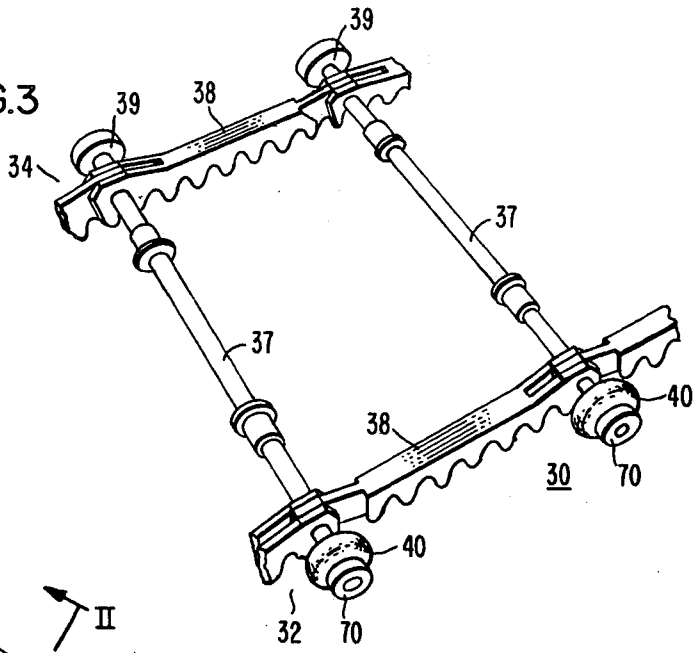
FIG. 3 is a fragmentary, perspective view of an endless belt to which the steps are attached, which belt is constructed according to the teachings of the invention.
Figure 2:
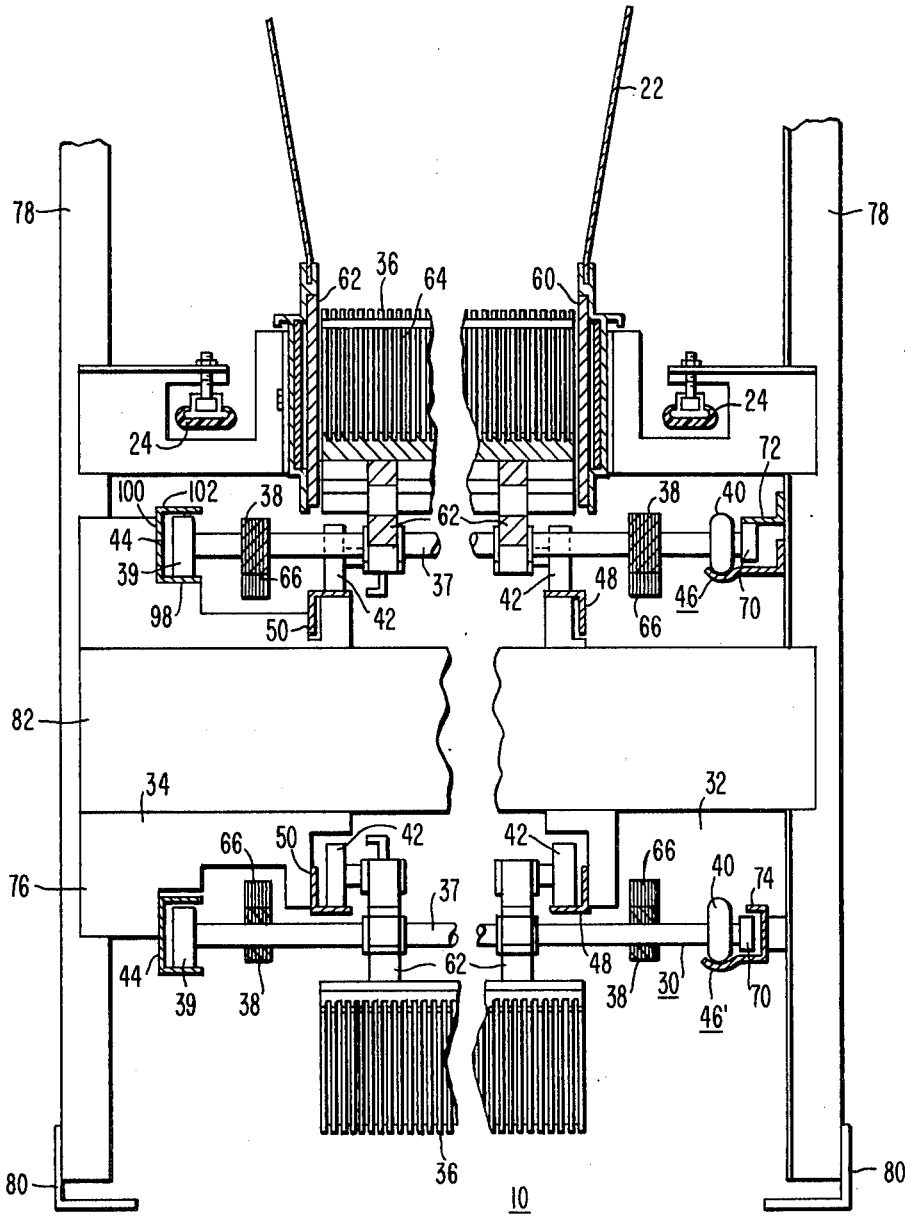
FIG. 2 illustrates a sectional view, in detail, taken transverse to the direction of movement of the escalator along the line between arrows II—II in FIG. 1.

As disclosed in U.S. Pat. No. 3,677,388, the conveyor 12 includes an endless belt 30 having first and second sides 32 and 34, respectively. Endless belt 30 is formed of toothed links 38, interconnected by the step axles 37 to which the steps 36 are connected. As illustrated in FIG. 2, which is a cross-sectional view of the escalator 10 shown in FIG. 1, taken between arrows II—II, the steps 36 are supported by main and guide rollers 39 and 40, respectively, at the first and second opposite sides 32 and 34 of the endless belt 30, and by trailer rollers 42. The main and guide rollers 39 and 40 cooperate with the support and guide tracks 44 and 46, respectively, and the trailer rollers 42 cooperate with the trailer tracks 48 and 50, to guide the steps 36 in the endless path or loop. FIG. 3 is a fragmentary, perspective view of the endless belt 30, which more clearly illustrates its construction.

Returning to FIG. 1, the steps 36 are driven by a modular drive unit 52 which includes sprocket wheels and a drive chain for engaging the toothed links 38. The modular drive unit 52 includes a handrail drive pulley 54 on each side of the conveyor, which drives the handrail drive units 56.

A skirt, commonly called a skirt board or skirt guard, is disposed immediately adjacent the sides of the steps 36, such as skirts 60 and 62 disposed on sides 32 and 34, respectively, of the endless belt 30, with skirt 60 being shown in fragmentary form in FIG. 1.

Referring now to FIG. 2 for a more detailed structural description of escalator 10, each step 36 is pivoted for rotational movement about a step axle 37 passing through the step frame members 62. The steps are journaled to the axles 37 in a manner which prevents axial movement between the steps and the axles. An improved step clamp arrangement which may be used is fully described in U.S. Pat. No. 3,789,972, which is assigned to the same assignee as the present application. Main support rollers or wheels 39 are rotationally mounted to ends of the step axles 37 on the second side of the endless belt, and rollers 39 ride on tracks 44 on both the upper load bearing run 18 and the return run 20 of the escalator.

Main guide rollers 40 constructed according to the teachings of the invention, are rotationally mounted adjacent to the ends of the step axles 37 which are located on the first side 32 of the endless belt 30, and these rollers or wheels ride in a guide track 46, which is also constructed according to the teachings of the invention. A plurality of guard rollers or wheels 70 are rotationally mounted on the same end of the step axles 37 as the guide rollers 40, with the guard wheels 70 cooperating with a guard track to provide the upthrust limit, as well as limiting lateral movement of the endless belt. The location of the guard track relative to the guard wheels 70 may be adjustable, as illustrated at 72, it may be fixed, such as being an integral part of the guide track, as illustrated at 74, or the guard track may include combinations of these two structures. This new supporting, guiding and upthrust limit arrangement will be hereinafter described in detail.

Journaled to the step frame members 62, adjacent to the bottom of the riser portion 64 of the step, are the trailer wheels 42 which are guided by L-shaped trailer tracks 48 and 50 on the first and second sides 32 and 34, respectively, of the endless belt 30.

The individual steps are connected to the articulated endless belt 30 formed by rigid linkages 38 which are pivotally connected to the step axles 37 on either side of the steps 36. The linkages 38 are constructed of laminations of steel stampings having projections 66 which form teeth. The linkages have male and female connectors at opposite ends so that they cooperate with adjacent linkages to form a continuous rack. Drive units, such as drive unit 52, are spaced at intervals along the length of the stairway, as required by the rise, and these drive units mesh with the rack teeth on both the upper and return runs to impart a driving force to the escalator. The drive units and rack assemblies are more fully described in U.S. Pat. No. 3,677,388.

The tracks 44 for the main support rollers 39, and the tracks 50 for the trailer rollers, are also precision welded to the mounting plate 76. The mounting plate 76 is welded to the truss chord members 78. The truss chord members are welded to the lower truss beam members 80 at their lower extremity, and at their upper extremity to upper truss beams (not shown). Other truss chord members (not shown) are located at intervals along the length of the stairway. Diagonal truss members (not shown) give added strength to the supporting truss structure. The sides of the truss structure are rigidly connected by boxing members 82 which are welded to the mounting plates 76. The formed main guide tracks 46 and the guard tracks 72 may be precision welded directly to the truss chord members 78.

Figure 4:
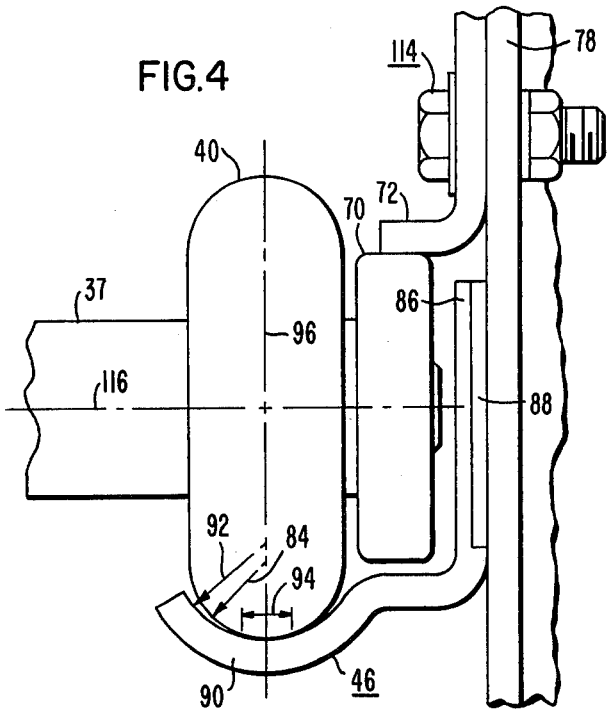
FIGS. 4, 5 and 6 are fragmentary, elevational views of guiding arrangements constructed according to different embodiments of the invention.

FIG. 4 is an enlarged view of the guide wheel 40, guard wheel 70, guide track 46 and guard track 72, illustrated in FIG. 2. In the preferred embodiment of the invention, the tread portion of the elastomeric tire which forms part of the guide wheel has a curved, convex outer surface when viewed in cross-section, which curve may be a segment of a circle having a radius 84, a segment of an ellipse, a segment of a parabola, or the like. The guide track 46 includes a mounting portion 86, which may be precision welded to the spaced truss chords 78, indicated by weld 88, or otherwise suitably fastened to the stairway truss. The guide track 46 also includes a support and guide portion 90 which includes a curved, concave surface when viewed in cross-section, which curve may be a segment of a circle having a radius 92, or other suitable curve compatible with the cross-sectional configuration of the guide wheel. It is important to note that the radius 92 exceeds the radius 84 of the tread on the guide wheel 40. This difference in radii promotes substantially a "line" contact between the guide wheel 40 and the guide track 46, with this line contact being indicated by arrow 94. This cooperative arrangement substantially eliminates differential velocities between the wheel and track. Any lateral forces in the endless belt 30 and steps which cause the guide wheels 40 to move transverse to the direction of travel of the endless belt 30 is resisted by self-centering forces between the wheel 40 and guide track 46, and as the wheel 40 rides up the slope of the guide track in either lateral direction, the different radii prevent contact of the wheel sidewall and the side portions of the guide track, with the center of the "line" contact 94 merely shifting from the vertical axis 96 to the left, or to the right, depending upon the direction of wheel movement. As illustrated in FIG. 2, the support wheel 39 at the other end of the step axle 37 may have the normal flat outer surface when viewed in cross-section, and it may ride on the conventional flat surface of a track 44 which has a generally C-shaped cross-sectional configuration. The welding and placement of jigs and fixtures during the manufacture of the escalator 10 are greatly simplified, as the alignment and placement of only one track, i.e., the guide track 46, is critical, unlike most prior art arrangements wherein the placement of guide angle members on both sides of the endless belt is critical. The benefits obtained during manufacture are also realized throughout the installation and alignment procedure in the field. Since the guide track controls the step guidance, the alignment and position of the flat support portion 98 of the support track 44 are not critical, allowing, within a reasonable tolerance, freedom of motion of the flat track in a horizontal plane. The support track 44 includes a side portion 100 which provides a lateral limit for the endless belt on the second side 34 of the belt, and it includes a top portion 102 which functions as an upthrust track for the flat main support rollers 39. In normal operation, the lateral limit provided by side portion 100 will never be reached, because the guide wheel - guard wheel combination limits the lateral movement of the endless belt.

The contoured tread structure of the guide rollers 40 does not make it desirable for this roller to be subjected to the scraping and scuffing which would be provided by the normal upthrust track. The upthrust function is provided, according to the teachings of the invention, by a third wheel or roller 70 on each step axle 37, which wheel is coaxial with the main support and guide wheels 39 and 40, respectively. As illustrated in FIG. 4, this third roller 70 which is referred to as a guard wheel or roller, is preferably smaller in O.D. than the adjacent guide roller, and it is preferably mounted outside of the guide roller relative to the side 32 of the endless belt 30. This is the preferred construction as it simplifies the structure, allowing the guide track 46 to provide the curve portion 90 and still maintain a space from the guard roller 70 as it proceeds to its mounting portion 86.

The separate guard wheel 70 not only prevents wear and damage to the guide wheel 40, but it enables a higher precision guiding arrangement of the endless belt 30 to be achieved in certain areas of the loop which are more critical than others. As illustrated in FIG. 1, these more critical areas are the upper turn-around, indicated by the curved arrow 104, the upper combplate area, indicated by arrow 106, the drive area, indicated by arrow 108, the lower combplate area, indicated by arrow 110, and the lower turnaround, indicated by the curved arrow 112. In these more critical guiding areas the guard track 72 is a separate adjustable structure having a vertically oriented slot for receiving mounting hardware 114 which secures the guard track to the truss chord 78. As illustrated in FIG. 4, the guard track is adjusted such that it contacts the guard rollers 70, which forces the guide rail 40 to track at the lowest point of the guide track 46, and thus assure precise alignment of the endless belt 30 and its connected steps, both laterally, and in the direction perpendicular thereto. The guide and guard rollers will thus rotate in opposite circumferential directions through these more critical guide areas, contacting the guide and guard tracks, respectively, on opposite sides of the rotational axis 116 of the three coaxial wheels which are journaled to each step axle 37.

Figure 5:
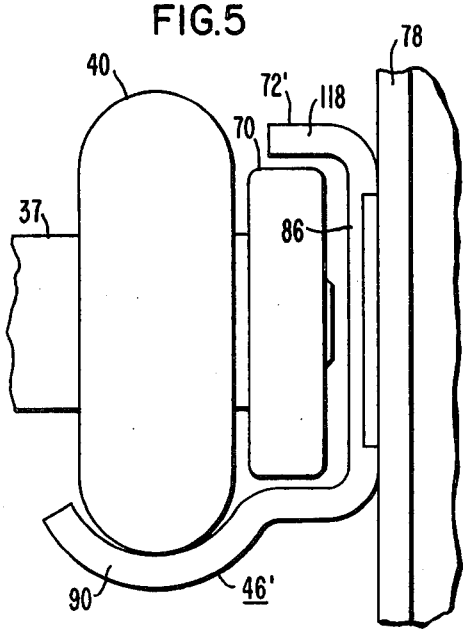

The remaining sections of the guard track 72 may also be adjustable, as illustrated in FIG. 4, or as illustrated in FIG. 5, the guard track 46' may include an integrally formed extension 118 from the mounting portion 86, which extension 118 forms the guard track 72'. In the less critical guide areas, the guard track may be spaced from the guard wheel 70 to provide the upthrust limit function, as well as to set the limits for lateral movement. Should the guard roller 70 contact the guard track 72', it will do so with very little scuffing or wear since it is not already rotating opposite to the direction of the rotational direction which would be imparted to it by such contact with the guard track.

Figure 6:
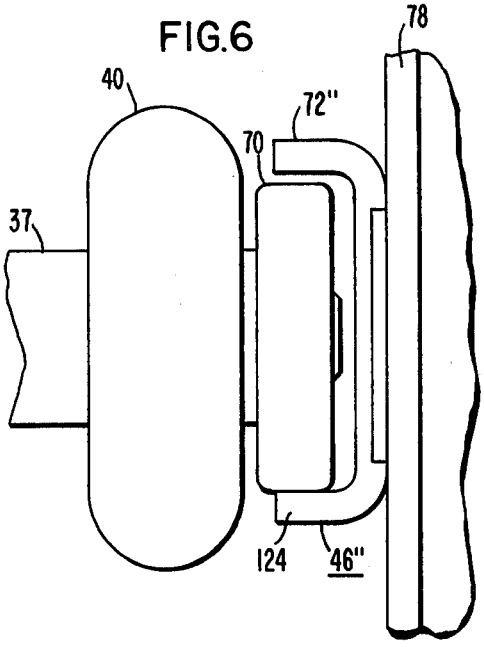

Most escalators include a transition zone between the upper and lower turn-arounds or newels and the remaining portion of the escalator structure, which areas are indicated by arrows 120 and 122, respectively, in FIG. 1. The transition zones permit the length of the stairway to be adjusted at each newel area, and as such they usually include wheel tracks with sliding joints which allow adjustment in the transition area. If the specific adjustment or joint utilized would not be suitable for a curved guide roller, the use of the third wheel 70 permits the guide track to be eliminated in the transition areas 120 and 122, and to provide an adjustable guard track for the guard wheel 70 in this transition area having a flat support portion or surface position to support the flat guard wheels across the transition area. FIG. 6 illustrates this embodiment of the invention, illustrating a guide track 46'' with no support for the guide wheel 40, but with a supporting portion 124 for the guard wheel 70. The adjustable transitional track 46'' includes an upper portion 72'' for limiting upthrust of the guard wheels in this area.

While the preferred embodiments of the invention have been shown and described, it is to be understood that the invention encompasses other embodiments, such as reversing the cross-sectional configurations of the guide wheel and guide track, to provide a concave surface on the guide wheel which rides on a convex surface of a guide rail. In this embodiment, the curves would also be different, but the curve on the tread portion of the guide wheel would exceed the radius of the curve on the guide track, to prevent the interference which would be caused by utilizing like radii. Also, the guard wheel may have an O.D. which exceeds that of the guide wheel and/or it may be mounted between the links and the guide wheel, instead of at the extreme end of the step axles.

In summary, there has been disclosed a new and improved escalator which guides the movable belt and connected steps from a single side of a movable belt, making only one of the main wheel support tracks critical in its alignment. Further, the new guiding arrangement functions without offsetting disadvantages, such as introducing accelerated wear, vibration or noise into the system. Still further, the invention enables ultra-precision guiding of the movable belt and attached steps in those highly critical areas of the loop, by utilizing a third or guard roller on the same side of the movable belt as the guide wheels, which cooperates with a guard track to force the guide wheel and its associated guide track to maintain the desired guide angle.

I claim as my invention:

1. An escalator, comprising:
an endless belt having first and second sides,
a plurality of steps attached to said endless belt,
means for driving said endless belt in a loop which includes load bearing and return runs for said steps,
a plurality of guide wheels rotatably mounted on the first side of said endless belt, said guide wheels each having a tread portion having a curved cross-sectional configuration,
a plurality of support wheels rotatably mounted on the second side of said endless belt,
a guide track on the first side of said endless belt, said guide track having a support portion having a curved cross-sectional configuration which supports the curved tread portions of said guide wheels, with the cross-sectional configurations of the non-flat portions of the guide wheel and guide track defining first and second different curves selected to promote substantially a line contact between each guide wheel and said guide track, wherein only a predetermined central portion of each guide wheel normally comes into contact with the guide track,
a support track on the second side of said endless belt for supporting said support wheels,
a plurality of guard wheels rotatably mounted on the first side of said endless belt with the rotational axis of each guard wheel being on a rotational axis of one of said guide wheels,
and a guard track mounted to limit the lateral movement of the guide wheels, as well as movement perpendicular thereto, by contacting the guard wheels and rotating the guard wheels opposite to the rotational direction of the guide wheels.

2. An escalator, comprising:
an endless belt having first and second sides,
a plurality of steps attached to said endless belt,
means for driving said endless belt in a loop which includes load bearing and return runs for said steps,
and means for guiding said belt about said loop including a plurality of guide wheels rotatably mounted on said first side of said endless belt on axes perpendicular to the travel direction of the endless belt, and a guide track adjacent to said first side, said guide wheels having a non-flat portion and said guide track having a cooperative non-flat portion, providing a curved interface which guides said guide wheels, with the cross-sectional configurations of the non-flat portions of the guide wheel and guide track defining first and second different curves selected to promote substantially a line contact between each guide wheel and said guide track, wherein only a predetermined central portion of each guide wheel normally comes into contact with the guide track.

3. The escalator of claim 2 wherein the cross-sectional configurations of the non-flat portions of the guide wheel and guide track define segments of first and second circles having different radii selected to provide normal contact between the guide wheel and guide track only at the central portions of the respective segments.

4. The escalator of claim 2 wherein the cross-sectional configuration of the non-flat portion of the guide track defines a concave surface for receiving the guide wheel.

5. The escalator of claim 4 wherein the cross-sectional configuration of the non-flat portion of the guide wheel defines a convex surface having a smaller radius than the radius of the concave surface of the guide track.

6. The escalator of claim 2 including a plurality of support wheels mounted on the second side of the endless belt having a tread portion with a flat cross-sectional configuration, and a support track mounted on the second side of the endless belt for cooperation therewith, said support track having a flat surface which supports said flat support wheels without a lateral guiding action.

7. The escalator of claim 2 including a plurality of guard wheels rotatably mounted on the first side of the endless belt on axes perpendicular to the travel direction of the endless belt, and a guard track adjacent to said guard wheels, said guard track being spaced from the guide track, on the opposite side of the rotational axes of the guide wheels from the guide track.

8. The escalator of claim 7 wherein each guard wheel is coaxial with a guide wheel.

9. The escalator of claim 7 wherein the guard track contacts the guard wheels, at least during a certain portion of the loop.

10. The escalator of claim 7 wherein the guard track is spaced from the guard wheels during predetermined portions of the loop, and the guard track contacts the guard wheels during other portions of the loop.

11. The escalator of claim 7 wherein the guard track has a flat surface and the outer periphery of each guard wheel defines a cross-sectional configuration for cooperation with the flat surface of the guard track.

12. The escalator of claim 7 wherein the guide track is discontinuous, and including a support track for the guard wheels disposed to provide support for the endless belt where such support is not provided by the discontinuous guide track.

13. The escalator of claim 7 wherein the O.D. of a guard wheel is less than the O.D. of a guide wheel.

14. The escalator of claim 7 wherein each guard wheel is coaxial with a guide wheel, with each guard wheel mounted outside the associated guide wheel relative to the first side of the endless belt.

15. The escalator of claim 14 wherein the O.D. of a guard wheel is less than the O.D. of the associated guide wheel.

16. The escalator of claim 15 wherein the guide and guard tracks are integrally formed of a single structural member, for at least a portion of the loop.

* * * * *